United States Patent [19]

Sasaki et al.

[11] 4,358,534

[45] Nov. 9, 1982

[54] SILVER HALIDE COLOR PHOTOGRAPHIC LIGHT-SENSITIVE ELEMENT

[75] Inventors: Noboru Sasaki; Hidefumi Sera; Nobutaka Ohki, all of Minami-ashigara; Jun Yamaguchi, Fujinomiya, all of Japan

[73] Assignee: Fuji Photo Film Co., Ltd., Kanagawa, Japan

[21] Appl. No.: 315,557

[22] Filed: Oct. 27, 1981

[30] Foreign Application Priority Data

Oct. 27, 1980 [JP] Japan ..... 55/150548

[51] Int. Cl.[3] ..... G03C 1/40

[52] U.S. Cl. ..... 430/537; 430/551; 430/372

[58] Field of Search ..... 430/551, 372, 537, 629, 430/636, 214

[56] References Cited

U.S. PATENT DOCUMENTS

| | | | |
|---|---|---|---|
| 2,701,197 | 2/1955 | Thirtle et al. | 430/372 |
| 2,710,801 | 6/1955 | Minsk et al. | 430/372 |
| 3,772,014 | 11/1973 | Scullard | 430/372 |
| 4,232,111 | 11/1980 | Miyazako et al. | 430/537 |

*Primary Examiner*—J. Travis Brown

*Attorney, Agent, or Firm*—Sughrue, Mion, Zinn, Macpeak, and Seas

[57] ABSTRACT

A silver halide color photographic light-sensitive material is described comprising a support and at least one light-sensitive silver halide emulsion layer having a coupler incorporated therein and at least one light-insensitive hydrophilic colloidal layer, whereby color mixing and color stain (color fog) phenomena are prevented from occurring at the time of color development, said light-insensitive hydrophilic colloidal layer(s) containing a polymer having a repeating unit represented by formula (I)

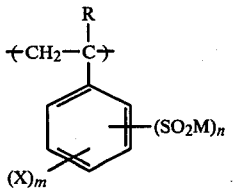

(I)

wherein R represents a hydrogen atom, an alkyl group containing from 1 to 6 carbon atoms, or a halogen atom; M represents a hydrogen atom, an alkali metal atom, an alkaline earth metal atom, or an organic base group; X represents an alkyl group containing from 1 to 6 carbon atoms, an alkoxy group having 1 to 6 carbon atoms, an alkylamino group having 1 to 6 carbon atoms, or a halogen atom; m represents 0, 1 or 2; and n represents 1 or 2.

3 Claims, No Drawings

SILVER HALIDE COLOR PHOTOGRAPHIC LIGHT-SENSITIVE ELEMENT

FIELD OF THE INVENTION

This invention relates to a silver halide color photographic light-sensitive element, and more particularly, to a silver halide color photographic light-sensitive element in which color mixing or color contamination or color fog are prevented from occurring at the time of color development.

BACKGROUND OF THE INVENTION

Known silver halide color photographic elements include those having coupler compounds incorporated therein which, when subjected to the color development, react with an aromatic primary amine type color developing agent which has been oxidized by the development of exposed silver halide to produce dyes, such as indophenol, indoaniline, indamine, azomethine, phenoxazine, phenazine and like dyes, and form colored images.

Therein, it is necessary to convert only the coupler which is incorporated in the same layer as light-sensitive silver halide, and more particularly, the coupler present in the vicinity of optically exposed silver halide into the corresponding dye in the color development process. In practice, however, this requirement frequently cannot be fully satisfied, and a phenomenon referred to as color fog or color contamination frequently occurs.

As one category of color fog, there is the phenomenon called airial fog, in which a developing agent is oxidized by air to some extent, and the resulting oxidized portion of developing agent reacts with couplers to form dyes at such places in the photographic material that any silver images are not formed.

As another example of color fog, mention may be made of a phenomenon in which there occurs the generation of stain or desensitization in a sensitive material having at least one coupler-containing silver halide hydrophilic colloidal layer provided on a hydrophobic support whose surface has just been exposed to electron beams, as described in U.S. Pat. No. 3,582,333.

Furthermore, the color mixing phenomenon becomes a problem in some multilayer color photographic elements in which plural emulsions differing in color sensitivity are coated in multiple layers on the same support. In order to obtain images having excellent color reproducibility in sensitive materials having multilayered structures, it is essential that only the coupler incorporated in the same layer as optically exposed silver halide develop a color.

However, a phenomenon also occurs which is called color mixing, in which oxidized aromatic primary amine type color developing agent which is produced in the step of color development does not remain only in the layer where it was produced, but some portion thereof diffuses into adjacent layers because of its low molecular weight, and, at the same time, oxidized developing agent from other layers diffuses into this same layer through the adjacent layers, resulting in a lack of correspondence of color sensitivity with color development. For instance, in the case of a negative type sensitive material is exposed to green light, natural color development ought to result solely in magenta-coloration, but, in practice, cyan- and yellow-colorations also occur. Furthermore, although these colorations occur to small extent, color reproducibility is lowered.

In general, the addition of a reducing substance to an interlayer, the uppermost layer, or the lowermost layer of coupler-containing silver halide photographic material, as described in U.S. Pat. Nos. 3,960,570, 3,700,453 and 3,582,333 has been employed for the purpose of the prevention of color mixing, color fog, and color stain. The reducing substances which have generally been employed for the above-described purpose are hydroquinone derivatives, with specific examples including those described in the foregoing U.S. Patents and U.S. Pat. Nos. 2,360,290, 2,403,721, 2,418,613, 2,701,197, 2,710,801, 2,735,765, 2,732,300, 2,704,713 and 3,700,453 and so on. However, as is noted in U.S. Pat. No. 3,960,570, it is known that a monoalkylhydroquinone having an alkyl moiety containing less than 9 carbon atoms diffuses through hydrophilic colloidal layers in the presence of a developing solution, that is, in the alkaline environment in which the hydroquinone compound is expected to have an effect on the prevention of color mixing and stain. Thus, such monoalkylhydroquinones do not stay in the intended layer and thus the intended result cannot be fully obtained and there is a possibility of undesirable adverse effects, to make matters worse. Methods which have been developed for preventing the above-described disadvantage are described in U.S. Pat. Nos. 2,360,290, 2,728,659 and 3,700,453.

According to the method described in U.S. Pat. No. 2,728,659, a hydroquinone derivative which is substituted with an alkyl group and slightly soluble to water is added to the intended layer in the form of dispersion, which is prepared by dissolving it in a high boiling point organic solvent which is also slightly soluble to water, such as dibutyl phthalate or tricresyl phosphate, and then dispersing the resulting solution into a hydrophilic colloidal medium in a state of fine droplets. One of the problems of this method is the low solubility of the hydroquinones substituted with alkyl groups in high boiling point solvents, as a consequence of which crystals separate out in the layer to which the dispersion is added. Another problem thereof is that an extra step is required for emulsifying and dispersing the hydroquinone compounds in a proper medium. Further, the specification of U.S. Pat. No. 3,700,453 describes that when di-t-octylhydroquinone or di-n-dodecylhydroquinone as described in U.S. Pat. No. 2,360,290 and 2,728,659 is used as the hydroquinone derivative, a large portion of the hydroquinone derivative separates out in a form of crystal even when tricresyl phosphate is employed in a proportion of 0.5 part to 1 part of the hydroquinone derivative, that is to say, it is practically impossible to use such hydroquinone derivatives for the above-described purpose. Furthermore, U.S. Pat. No. 3,700,453 describes a method for overcoming the above-described disadvantage in which two or more of hydroquinone derivatives substituted with secondary alkyl groups containing more than 9 carbon atoms are used in combination, and also describes a method for obtaining such mixtures in which hydroquinone and primary olefins having more than 9 carbon atoms are allowed to react with one another in the presence of a Lewis acid catalyst at a high temperature for an extended period of time, and the resulting reaction mixture is obtained therefrom by distillation. Although this method is considered to be a useful technique for obtaining stable emulsified dispersion, it is also supposed to suffer from the defect that it is difficult to stabilize the quality of the product so that the composition ratio of the components of the mixture is kept constant. Particularly, it is reported in Example 1 of the above-described patent that dodecylhydroquinone prepared by the reaction of hydroquinone with 1-dodecene was confirmed by chromatography to be the mixture of five kinds of monoalkyl substituted hydroquinones and twelve kinds of dialkyl substituted hydroquinones, and therefore it is thought to be nearly impossible for the composition ratios to be kept constant.

The above-described method suffers from another defect in that the efficiency per unit weight is low, which is believed to result from the small proportion of the photographically active hydroquinone moiety with respect to the alkyl substituent moiety.

In order to remove these defects regarding nondiffusibility and the stability of emulsified dispersion, diffusion-resistant hydroquinone polymers have been developed, as described in U.S. Pat. No. 2,816,028. However, the introduction of hydrophilic groups is required for introducing hydroquinone moieties into a polymer and consequently, the proportion of hydroquinone moiety in the polymer per unit weight is decreased.

SUMMARY OF THE INVENTION

It is, therefore, a purpose of this invention to prevent the above-described color mixing and color fog, contamination or staining from occurring in color photographic materials.

More specifically, a first object of this invention is to provide a color photographic element which produces colored images having excellent color separation as a result of the prevention of the color mixing to a very appreciable extent.

A second object of this invention is to provide a color photographic element in which color mixing and color fog, and contamination or staining are prevented using a method which does not require any complex steps (such as an emulsifying step).

A third object of this invention is to provide a color photographic element substantially free from stain which is produced by using materials which themselves cause no stain.

A fourth object of this invention is to provide a color photographic element free from color fog which is believed to result from air oxidation products of developers used.

A fifth object of this invention is to provide a color photographic element which is free from stain even though it is prepared by coating silver halide emulsions in a multilayer form on a hydrophobic resin support whose surface has just been exposed to electron beams.

The above-described objects have now been attained by a silver halide color photographic light-sensitive element comprising a support and at least one light-sensitive silver halide emulsion layer having a coupler incorporated therein and at least one light-insensitive hydrophilic colloidal layer, said light-insensitive hydrophilic colloidal layer containing a polymer containing a repeating unit represented by formula (I)

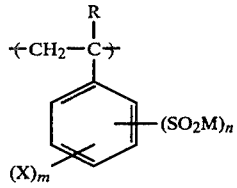

(I)

wherein R represents a hydrogen atom, an alkyl group containing from 1 to 6 carbon atoms, or a halogen atom; M represents a hydrogen atom, an alkali metal atom, an alkaline earth metal atom, or an organic base group; X represents an alkyl group containing from 1 to 6 carbon atoms, an alkoxy group having 1 to 6 carbon atoms, an alkylamino group having 1 to 6 carbon atoms, or a halogen atom; m represents 0, 1 or 2; and n represents 1 or 2.

DETAILED DESCRIPTION OF THE INVENTION

Polymers containing the repeating unit of formula (I) in this invention include homopolymers obtained by polymerizing the monomer represented by formula (II) below, copolymers obtained by copolymerizing the monomer represented by formula (II) with another monomer having at least one addition polymerizable unsaturated bond, polymers obtained by introducing sulfinic acid groups thereinto after the polymerization reaction, and their respective derivatives. Formula (II) is as follows,

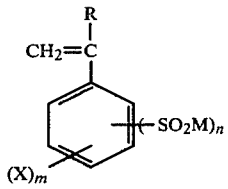

(II)

and R, M, X, m and n have the same meanings as in the case of formula (I).

Specific examples of the monomers represented by formula (II) are illustrated below.

Monomer (A)

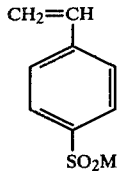

Monomer (B)

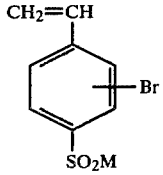

Monomer (C)

-continued

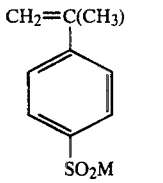

Monomer (D)

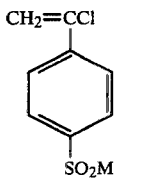

Monomer (E)

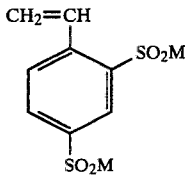

Of these monomers, (A) is the most preferable compound. Monomer (A) can be synthesized using a method as described in *Chemistry Letters,* pp. 419–420 (1976). However, synthetic methods therefor are not limited to the above-described method. So long as the corresponding sulfonic acid chlorides can be prepared in advance other monomers also can be synthesized using the same basic method as that which described in *Chemistry Letters,* supra, or by reduction with a reducer such as sodium sulfite or the like, and, if necessary, but subsequent vinylation.

On the other hand, the polymer having the repeating unit represented by formula (I) can be synthesized using a polymer such as polystyrene and the like as a starting material under conditions suitable for polymer reactions.

So long as the monomers have at least one addition polymerizable unsaturated bond in their individual molecule, they can generally be employed as the monomers with which the monomer represented by formula (II) can be allowed to copolymerize. Specific examples of such addition polymerizable unsaturated compounds include allyl compounds such as allyl esters (e.g., allyl acetate, allyl caproate, allyl caprate and allyl laurate) and the like; vinyl ethers (e.g., methyl vinyl ether, butyl vinyl ether, hexyl vinyl ether, octyl vinyl ether, decyl vinyl ether, ethylhexyl vinyl ether and methoxyethyl vinyl ether); vinyl esters (e.g., vinyl acetate, vinyl propionate, vinyl butyrate, vinyl isobutyrate, vinyl dimethylpropionate, vinyl ethylbutyrate, vinyl valerate, vinyl caprate, vinyl chloroacetate, vinyl benzoate, vinyl salicylate and vinyl chlorobenzoate); vinyl heterocyclic compounds (e.g., N-vinyloxazolidone, N-vinylimidazole, N-vinylpyrrolidone and N-vinylcarbazole); styrenes (e.g., styrene, methylstyrene, dimethylstyrene, trimethylstyrene, ethylstyrene, diethylstyrene, isopropylstyrene, butylstyrene, hexylstyrene, fluorostyrene, chloromethylstyrene and chlorostyrene); crotonic acid compounds (e.g., crotonic acid, crotonic acid amide and crotonic acid esters); vinyl ketones (e.g., methyl vinyl ketone); olefins (e.g., dicyclopentadiene, ethylene, propylene, 1-butene, 1-pentene, 1-hexene and 4-methyl-1-pentene); itaconic acids (e.g., itaconic acid and itaconic anhydride); halogenated olefins (e.g., vinyl chloride and vinylidene chloride); acrylic acid compounds (e.g., acrylic acid and methylacrylate); methacrylic acid compounds (e.g., methacrylic acid and methylmethacrylate); acrylamides; methacrylamides; and so on.

Of these addition polymerizable unsaturated compounds, styrenes, vinyl heterocyclic compounds, vinyl ethers, vinyl esters, and olefins are preferred.

This invention requires that the polymer to be employed contain therein at least 0.1 mol%, preferably at least 1 mol%, and more preferably at least 10 mol% of the repeating unit represented by formula (I). If the polymer contains the repeating units represented by formula (I) in fractions of less than 0.1 mol%, they do not have the intended effect at all. The intended effect can be achieved when one or more polymers which meet the above-described requirements are added to a light-insensitive hydrophilic colloidal layer in such a proportion as to constitute from 0.01 to 99 wt%, preferably from 0.1 to 50 wt%, and more preferably from 1 to 30 wt%, of the total weight on dry basis of gelatin and the polymer contained in the light-insensitive hydrophilic colloidal layer.

When the amount of the polymer added is small, the effect obtained becomes weaker. On the other hand, when the amount of the polymer added is large, it happens that the coating solution comes to have high viscosity by the addition of the polymer in a large amount and consequently, the coating thereof becomes difficult, or it becomes impossible to set gelatin. In addition, these polymers can function effectively when they have molecular weights of, desirably, from 1,000 to 2,000,000, and, more preferably, from 10,000 to 500,000. In the case of too low a molecular weight, undesirable diffusion phenomenon may be caused. On the other hand, in the case of too high a molecular weight, in viscosity of the coating solution becomes too high due to the addition of the polymer.

Specific compound examples of the polymer which can be employed in this invention are illustrated below. Therein, all composition ratios are expressed as molar ratios.

Compound Example (1)

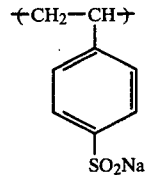

Compound Example (2)

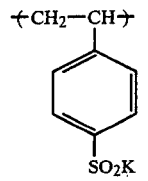

Compound Example (3)

-continued

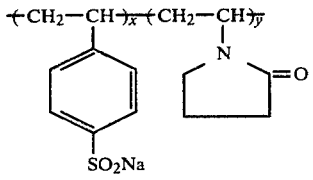

x/y = 80/20

Compound Example (4)

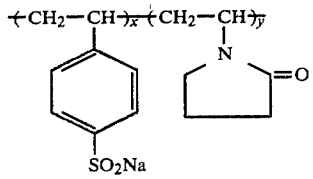

x/y = 50/50

Compound Example (5)

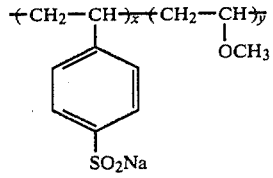

x/y = 80/20

Compound Example (6)

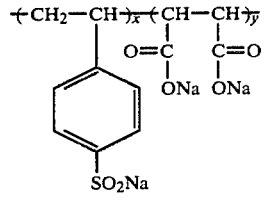

x/y = 50/50

Compound Example (7)

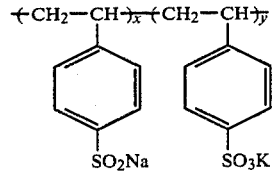

x/y = 75/25

Compound Example (8)

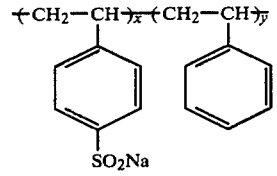

x/y = 70/30

Compound Example (9)

-continued

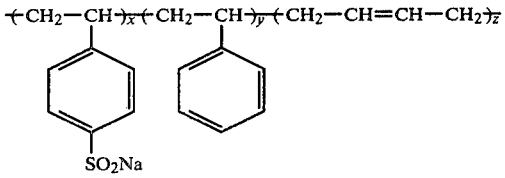

x/y/z = 80/10/10

Compound Example (10)

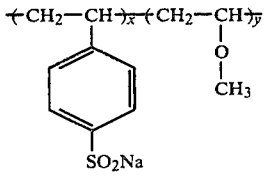

x/y = 90/10

Compound Example (11)

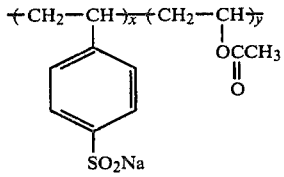

x/y = 80/20

Compound Example (12)

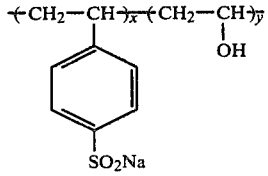

x/y = 80/20

Compound Example (13)

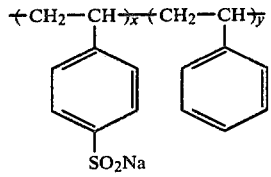

x/y = 95/5

Compound Example (14)

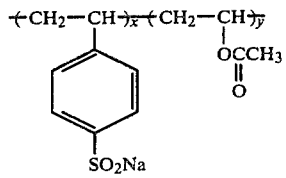

x/y = 90/10

The compounds of this invention are added to light-insensitive hydrophilic colloidal layers of a silver halide color photographic element. Such light-insensitive hydrophilic colloidal layers include, for example, an interlayer, a filter layer, a surface protecting layer, a color mixing prevention layer and so on.

Gelatin is usually employed as the hydrophilic colloid of such light-insensitive hydrophilic colloidal layers.

Gelatins employable in this invention include so-called alkali-processed (lime-processed) gelatin which is soaked in an alkali bath prior to the extraction of gelatin in its manufacturing process, acid-processed gelatin which is soaked in an acid bath instead of the above-described alkali bath, and enzyme-processed gelatin as described in *Bull. Soc. Sci. Photo. Japan*, No. 16, p. 30 (1966). In addition, low molecular weight gelatins which are prepared by partially hydrolyzing the above-described gelatins by heating them in a water bath or by making proteolytic enzyme act on gelatins can be also employed.

The gelatin used in this invention can optionally be replaced in some portion thereof by colloidal albumin; casein; cellulose derivatives such as carboxymethyl cellulose, hydroxyethyl cellulose and the like; sugar derivatives such as agar, sodium alginate, starch derivatives and the like; and synthetic hydrophilic colloids such as polyvinyl alcohol, poly-N-vinylpyrrolidone, acrylic acid copolymers, polyacrylamide and its derivatives or partially hydrolyzed products thereof. The gelatin can also be replaced partially by gelatin derivatives which are obtained by modifying functional groups contained in gelatin molecule, for example, amino group, imino group, hydroxy group and carboxyl group, through the processing with a reagent having at least one group capable of reacting with one of the above-described groups; or graft polymers obtained by grafting gelatins on the molecular chain of another macromolecular substance.

In the light-insensitive hydrophilic colloidal layer, a gelatin hardener, a surface active agent, polymer latex, a matting agent, dyes, an ultraviolet absorbing agent, a discoloration inhibitor, a plasticizer, a slipping agent, an antistatic agent and so on can be optionally incorporated. For details of these additives *Research Disclosure*, Vol. 176, pp. 22–28 (Dec. 1978) can be referred to.

More specifically, examples of the gelatin hardener which can be preferably employed in this invention include aldehydes (e.g., formaldehyde, glyoxal, glutaraldehyde, etc.), N-methylol compounds (e.g., dimethylol urea, methylol hydantoin, etc.), dioxane derivatives (e.g., 2,3-dihydroxydioxane, etc.), active vinyl compounds (e.g., 1,3,5-triacryloylhexahydro-s-triazine, bis(-vinylsulfonyl)methyl ether, etc.), active halogen compounds (e.g., 2,4-dichloro-6-hydroxy-s-triazine, etc.), mucohalogenic acids (e.g., mucochloric acid, mucophenoxychloric acid, etc.), isooxazoles, dialdehyde starch, 2-chloro-6-hydroxytriazinylated gelatin, and so on.

Examples of surface active agents which can be preferably employed in this invention include natural surface active agents such as saponin or the like; nonionic surface active agents such as those of alkylene oxide series, those of glycerin series, those of glycidol series and the like; cationic surface active agents such as higher alkyl amines, quaternary ammonium salts, heterocyclic compounds like pyridine, phosphoniums, sulfoniums and so on; anionic surface active agents which contain acidic groups such as carboxylic acid group, sulfonic acid group, phosphoric acid group, sulfuric acid ester group, phosphoric acid ester group and the like; and amphoteric surface active agents such as amino acids, aminosulfonic acids, sulfuric or phosphoric acid ester of amino-alcohols, and so on.

Light-sensitive silver halide emulsions employed in this invention are generally prepared by mixing a water-soluble silver salt (e.g., silver nitrate) solution and a water-soluble halide (e.g., potassium bromide) solution in the presence of a water-soluble high polymer solution (like a gelatin solution). Suitable examples of these silver halides include silver chloride, silver bromide and mixed silver halides such as silver chlorobromide, silver iodobromide, silver chloroiodobromide and the like. Such photographic emulsions are described in C. E. K. Mees & T. H. James, *The Theory of the Photographic Process*, 3rd Ed., Macmillan, New York (1966).

As for color couplers which can be employed in this invention, suitable examples of magenta couplers include 5-pyrazolone couplers, pyrazolobenzimidazole couplers, cyanoacetylcumarone couplers, open chain acylacetonitrile couplers and so on; suitable examples of yellow couplers include acylacetamide couplers (e.g., benzoylacetanilides, pivaloylacetanilides and the like) and so on; and suitable examples of cyan couplers include naphthol couplers, phenol couplers and so on. These couplers desirably have hydrophobic groups called ballast groups, and thereby are rendered non-diffusible. Couplers may be either 4-equivalent or 2-equivalent with respect to the silver ion. Moreover, couplers may be colored couplers having a color correction effect, or couplers capable of releasing development restrainers with the progress of development (so-called DIR couplers). Furthermore, non-colored DIR coupling compounds which yield colorless products upon the coupling reaction though even while they release development restrainers in analogy with DIR couplers may be included in the couplers employable in this invention.

The color coupler is added to an emulsion layer in an amount of from $2\times10^{-3}$ to 2 mols, and preferably from $1\times10^{-2}$ to $5\times10^{-1}$ mol, per 1 mol of silver contained therein.

The coupler is incorporated into a silver halide emulsion layer using a known method, for example, the method described in U.S. Pat. No. 2,322,027. The coupler is dissolved in a high boiling point organic solvent, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethylsuccinate, dioctylazelate, etc.), trimesic acid esters (e.g., tributyltrimesate, etc.) or so on; or an organic solvent having a boiling point ranging from about 30° C. to 150° C., for example, a lower alkyl acetate such as ethyl acetate, butyl acetate or the like, ethyl propionate, secondary butyl alcohol, methyl isobutyl ketone, β-ethoxyethyl acetate, methyl cellosolve acetate, etc., and is then dispersed into a hydrophilic colloid. In order to dissolve the coupler, a mixture of one of the above-described high boiling point organic solvents and one of the above-described low boiling point organic solvents may also be employed.

In addition, a dispersing technique utilizing a polymer, as described in Japanese Patent Publication No. 39853/76 and Japanese Patent Application (OPI) No. 59943/76 (the term "OPI" as used herein refers to a "published unexamined Japanese patent application"), can also be employed for the incorporation of the coupler into the silver halide emulsion layer.

If the coupler contains an acid group, such as carboxylic acid group or sulfonic acid group, it can be introduced into the hydrophilic colloid in a form of alkaline aqueous solution.

To the light-sensitive silver halide emulsion layer of this invention, various kinds of additives, such as an antifogging agent, chemical sensitizers, spectral sensitizing dyes, a gelatin hardener, a surface active agent, polymer latex and so on, can be added in addition to the above-described components. These additives are described in *Research Disclosure*, Vol. 176, pp. 22–28 (1978).

In the case of using the polymers of this invention, each of the layers constituting a photographic light-sensitive material can be coated using one of various coating techniques including a dip coating technique, an air knife coating technique, a curtain coating technique, a spray coating technique, and an extrusion coating technique utilizing a hopper, as described in U.S. Pat. No. 2,681,294.

Synthesis examples of the compounds to be employed in this invention are described below. However, the syntheses thereof are not intended to be construed as limiting the invention to these examples.

SYNTHESIS EXAMPLE A

Synthesis of Sodium Vinylbenzenesulfinate (Compound (A)) 1–1 Synthesis of p-(β-Bromoethylbenzene)sulfonyl Chloride 84.3 g of 30% fuming sulfuric acid was weighed out and placed in a three-neck flask equipped with a stirring device. Thereinto were added dropwise 58.8 g (0.32 mol) of β-bromoethylbenzene and 26.1 g (0.636 mol) of acetonitrile, while the temperature of the liquid was kept at from 20° to 23° C. After the completion of the dropwise addition a temperature of the reaction solution was increased up to from 40° C. to 45° C. and, as the temperature was maintained at that value 92.3 g (0.795 mol) of chlorosulfonic acid was added dropwise thereto. After the completion of the dropwise addition the temperature of the reaction solution maintained for some time in order to complete the reaction. Thereafter, the reaction product was poured into 1 liter of ice water, whereby the product was separated out in a crystallized condition. It was filtered off, dried and recrystallized from hexane. The yield of the product was 59%, and the melting point thereof was 54°–55° C.

1–2 Synthesis of p-(β-Bromoethylbenzene)sulfinic Acid

A 42.5 g (0.15 mol) portion of the p-(β-bromoethylbenzene)sulfonyl chloride obtained in the above-described reaction was placed in a 500 cc three-neck flask together with 210 cc of glacial acetic acid. Thereinto was added 12.8 g of zinc powder with stirring at a temperature of 25° C. to 35° C. After the completion of the addition, the stirring was further continued for 1 hour at 35° C. Then, 128 ml of concentrated hydrochloric acid and 106 ml of water were added, and the temperature of the bath was increased up to about 80° C. After the contents were completely dissolved, they were cooled in an ice bath. The thus-produced crystal was filtered off, and recrystallized from water. The yield of the product was 42%, and the melting point thereof was 105°–107° C.

1–3 Synthesis of Sodium Vinylbenzenesulfinate (Compound (A))

A 12.7 g (0.051 mol) portion of 2-bromoethylbenzenesulfinic acid obtained in the above-described reaction, 10.0 g (0.153 mol) of potassium hydroxide, 237 ml of methanol, and 0.14 g of hydroquinone were placed in a 500 cc of three-neck flask, and refluxed for 1 hour. Thereafter, methanol was evaporated from the reaction mixture to dryness and subsequently, 80 ml of water and 9 ml of concentrated hydrochloric acid were added thereto. The resulting solution was cooled in an ice bath, whereby vinylbenzenesulfinic acid was separated out in a crystallized condition. The crystal was filtered off, dissolved in water, neutralized with sodium hydroxide and then evaporated in order to remove water therefrom. Thus, the intended compound was obtained. The yield was 60%, and the melting point was more than 200° C.

SYNTHESIS EXAMPLE B

Synthesis of Sodium p-(α-Methylvinyl)benzenesulfinate (Compound (C))

α-Methylstyrene was subjected to a chlorosulfonation according to the same manner as in the step 1—1 of synthesis example A to be converted to p-(α-methylvinyl)benzenesulfonyl chloride. The thus-obtained p-(α-methylvinyl)benzenesulfonyl chloride was reduced in the same manner as in the step 1–2 of synthesis example A, and neutralized with sodium hydroxide to produce sodium p-(α-methylvinyl)benzenesulfinate. The yield of the product was 36%. The melting point thereof was more than 200° C.

SYNTHESIS EXAMPLE C

Synthesis of Sodium Vinylbenzene-2,4-disulfinate (Compound (E))

Barium salt of 1-(2-bromoethyl)benzene-2,4-disulfonic acid prepared using the method described in *Tr. Vses Nauch-Issed. Inst. Khim. Reaktiv. Osobo. Chist. Khim. Veschestv*, 1971, No. 33, 22–9 was allowed to react with chlorosulfonic acid in a conventional manner to obtain 1-(2-bromoethyl)benzene-2,4-disulfonic acid chloride. This compound was reduced in the same manner as in the step 1–2 of synthesis example A to be converted to 1-(2-bromoethyl)benzene-2,4-disulfinic acid and then subjected to vinylation according to the same procedure as in the step 1–3 of synthesis example A. Thus, vinylbenzene-2,4-disulfinic acid was obtained.

The homopolymers of vinylbenzenesulfinic acid salts included in the formula (I) can be also synthesized by reference to *Chemistry Letters*, pp. 419–420 (1976). These polymers can be obtained using not only the polymerization method described in the above-described literature, but also commonly used polymerization methods. On the other hand, copolymers of vinylbenzenesulfinic acid salts can be synthesized using general methods known in the art, for example, the method described in W. R. Sorenson & T. W. Campbell, *Kobunshi Gosei Jikken Ho* (*Methods for Experiments in Polymer Syntheses*), pp. 147 and 157, Tokyo Kagaku Dojin, Iokyo, and so on. Making an additional remark, the polymers of this invention can exhibit their intended effects even if they are used in any forms, for example, in a form of aqueous solution, in a form of organic solvent solution, or in a form of aqueous dispersion.

Moreover, the polymers having the repeating unit of the formula (I) can be obtained by either method, the method of polymerizing the monomer of the formula (II), or the method of introducing sulfinic acid group into the corresponding polymer. For instance, polystyrene or poly(α-methylstyrene) is used as a starting material, chlorosulfonated polystyrene is prepared in the same manner as in the above-described step 1—1 and then polystyrene having sulfinic acid groups in its benzene nuclei is obtained using the same procedure as in the above-described step 1-2.

SYNTHESIS EXAMPLE I

Synthesis of Compound Example (1)

30.0 g of sodium vinylbenzenesulfinate was dissolved in 300 cc of distilled water together with 1.5 g of potassium persulfate, and a polymerization reaction was conducted in an atmosphere of nitrogen gas at 70° C. for 24 hours. Thereafter, the resulting aqueous solution was dialyzed for 24 hours against distilled water, and then lyophilized.

The yield of the polymer obtained was 22.6 g. The value of reduced viscosity $\eta_{sp}/c$ (c=0.2 wt%) in the aqueous solution containing 1.5 mols of sodium bromide was 1.388.

SYNTHESIS EXAMPLE II

Synthesis of Compound Example (2)

32.5 g of potassium vinylbenzenesulfinate and 0.86 g of 2,2'-azobis(2-amidinopropane) hydrochloride were dissolved in 300 cc of distilled water, and polymerization reaction was conducted in the same manner as in Synthesis Example I. The yield was 28.5 g, and the value of reduced viscosity $\eta_{sp}/c$ (c=0.2 wt%) in the aqueous solution containing 1.5 mols of sodium bromide was 0.45.

SYNTHESIS EXAMPLE III

Synthesis of Compound Example (4)

10.0 g of sodium vinylbenzenesulfinate, 5.83 g of N-vinylpyrrolidone, and 0.570 g of 2,2'-azobis(2-amidinopropane) hydrochloride were dissolved in 200 cc of distilled water, and the polymerization reaction was conducted in the same manner as in Synthesis Example I. The yield was 16.0 g.

SYNTHESIS EXAMPLE IV

Synthesis of Compound Example (7)

15.0 g of sodium vinylbenzenesulfinate, 5.8 g of potassium vinylbenzenesulfonate, and 0.570 g of 2,2'-azobis(2-amidinopropane) hydrochloride were dissolved in 200 cc of distilled water, and polymerization was carried out under the same conditions as in Synthesis Example I. The yield of the polymer obtained was 19.9 g, and the reduced viscosity thereof $\eta_{sp}/c$ (c=0.2 wt%) in the aqueous solution containing 1.5 mols of sodium bromide was 1.850.

SYNTHESIS EXAMPLE V

Synthesis of Compound Example (11)

10 g of sodium vinylbenzenesulfinate, 1.13 g of vinyl acetate, and 0.356 g of 2,2'-azobisisobutyronitrile were dissolved in 200 cc of methanol, and polymerization was conducted at 60° C. for 24 hours. Thereafter, the resulting solution was dialyzed for 24 hours against distilled water, and then lyophilized.

SYNTHESIS EXAMPLE VI

Synthesis of Compound Example (12)

The compound example (11) was dissolved in a dilute sodium hydroxide aqueous solution, and hydrolyzed thoroughly at 60° C. Thereafter, the product was dialyzed, and then lyophilized.

The present invention will now be illustrated in greater detail by reference to the following examples. However, the invention is not intended to be construed as being limited to these examples.

EXAMPLE 1

On a cellulose triacetate film having thereon a conventional subbing layer, the layers lited below were coated in the order listed from the support side to prepare a coated sample (A).

Layer-1

Antihalation layer, wherein black colloidal silver was dispersed in gelatin (dry coverage: 2.0 microns).

Layer-2

Gelatin interlayer (dry coverage: 1.0 micron).

Layer-3

A red-sensitive silver halide emulsion layer having lower sensitivity which was prepared as follows: A silver iodobromide emulsion containing 5 mol% of iodine (having an average grain size of 0.3μ, and containing, per 1 kg of the emulsion, 100 g of silver halide and 70 g of gelatin) was prepared in a conventional manner. To a 1 kg portion of this emulsion, 210 cc of a 0.1% methanol solution of anhydro-5,5-dichloro-9-ethyl-3,3'-di(3-sulfopropyl)thiacarbocyanine hydroxide pyridinium salt was added as a red-sensitive spectral sensitizer. Subsequently, 20 cc of a 5 wt% aqueous solution of 5-methyl-7-hydroxy-2,3,4-triazaindolizine, 400 g of a cyan coupler emulsion (1) having the following formula, and 200 g of an emulsion (2) having the formula described below, were added, followed by the addition of 200 cc of a 2% aqueous solution of colored cyan coupler (CC-1) having the following structural formula, and the addition of 30 cc of a 2 wt% of aqueous solution of 2-hydroxy-4,6-dichlorotriazine sodium salt which functioned as a gelatin hardener. The thus-obtained red-sensitive silver halide emulsion solution having low sensitivity was coated at a dry coverage of 3.5 microns.

CC-1

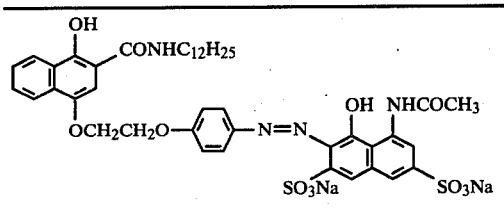

Emulsion (1)

| | | |
|---|---|---|
| (a) | 10 wt % Aqueous solution of gelatin | 1,000 g |
| (b) | Sodium p-dodecylbenzenesulfonate | 5 g |
| | Tricresyl phosphate | 60 cc |
| | Cyan coupler (C-101) | 70 g |
| | Ethyl acetate | 100 cc |

The mixture (b) was heated at 55° C. to form a solution. The resulting solution was added to (a), which had already been warmed to 55° C., and emulsified using a colloid mill.

C-101

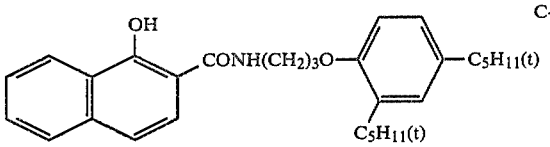

| Emulsion (2) | | |
|---|---|---|
| (a) | 10 wt % Aqueous solution of gelatin | 1,000 g |
| (c) | Sodium p-dodecylbenzenesulfonate | 5 g |
| | Tricresyl phosphate | 60 cc |
| | Cyan coupler (C-101) | 70 g |
| | DIR compound (D-1) | 10 g |
| | Ethyl acetate | 100 cc |

The mixture (c) was heated at 55° C. to form a solution. The resulting solution was added to (a), which was warmed to 55° C. in advance, and emulsified using a colloid mill.

D-1

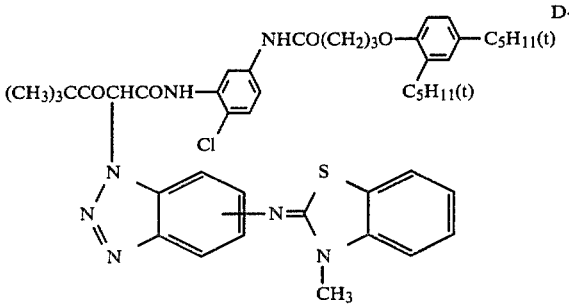

Layer-4

A red-sensitive silver halide emulsion layer having higher sensitivity was prepared in the same manner as in the layer-3, except that the average grain size of the emulsion was altered to 0.9 micron, the addition amount of the methanol solution of the red-sensitive spectral sensitizer was altered to 140 cc, the addition amount of the emulsion (1) was altered to 220 g, the addition amount of the emulsion (2) was altered to 30 g, and the dry coverage of the emulsion was altered to 2.2 microns.

Layer-5

A color mixing prevention layer was prepared as follows: A 170 g portion of emulsion (6) which contains the following amounts of ingredients, was added to 1,000 g of 10 wt% of gelatin aqueous solution and then coated at a dry coverage of 0.8 micron.

| Emulsion (6) | | |
|---|---|---|
| (a) | 10 wt % Aqueous solution of gelatin | 1,000 g |
| (d) | Sodium dodecylbenzenesulfonate | 12 g |
| | Tricresyl phosphate | 80 cc |
| | Color mixing inhibitor (I) | 40 g |
| | Ethyl acetate | 50 cc |

The mixture (d) was heated at 55° C. to form a solution. The resulting solution was added to (a) which was heated to 55° C. in advance, and emulsified using a colloid mill.

Color Mixing Inhibitor (I)

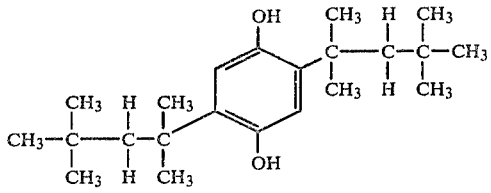

Layer-6

A green-sensitive silver halide emulsion layer having lower sensitivity was prepared as follows: To a 1 kg portion of the silver iodobromide emulsion employed in the layer-3 were added 180 cc of 0.1% methanol solution of 3,3'-di(2-sulfoethyl)-9-ethylbenzoxacarbocyanine pyridinium salt, which functions as a green-sensitive sensitizing dye, and 20 cc of a 5 wt% aqueous solution of 5-methyl-7-hydroxy-2,3,4-triazaindolizine, in the order listed. Further, 320 g of a magenta coupler emulsion (3) having the following formula, 180 g of the other magenta coupler emulsion (4) having the following formula, and 50 cc of a 2 wt% of aqueous solution of 2-hydroxy-4,6-dichlorotriazine sodium salt which acts as a gelatin hardener were added to the above-described silver halide emulsion. Thus, the green-sensitive silver halide emulsion having lower sensitivity was obtained, and it was coated at a dry coverage of 3.2 microns.

Layer-7

A green-sensitive silver halide emulsion layer having higher sensitivity was prepared in the same manner as in the layer-6, except that the average grain size of emulsion was altered to 1.0 micron, the iodine content in the emulsion to 6.5 mol%, the addition amount of the methanol solution of the green-sensitive spectral sensitizer to 100 cc, the addition amount of the emulsion (3) to 150 g, the addition amount of the emulsion (4) to 30 g, and the dry coverage of the emulsion was altered to 2.2 microns.

| Emulsion (3) | | |
|---|---|---|
| (a) | 10 wt % Aqueous solution of gelatin | 1,000 g |
| (e) | Sodium dodecylbenzenesulfonate | 5 g |
| | Tricresyl phosphate | 80 cc |
| | Magenta coupler (M-101) | 50 g |
| | Colored magenta coupler (CM-1) | 10 g |
| | Ethyl acetate | 120 cc |

The mixture (e) was heated at 55° C. to form a solution. The resulting solution was added to (a), which was warmed to 55° C. in advance, and emulsified using a colloid mill.

| Emulsion (4) | | |
|---|---|---|
| (a) | 10 wt % Aqueous solution of gelatin | 1,000 g |
| (f) | Sodium dodecylbenzenesulfonate | 5 g |
| | Tricresyl phosphate | 80 cc |
| | Magenta coupler (M-101) | 50 g |
| | Colored magenta coupler (CM-1) | 10 g |
| | DIR compound (D-1) | 15 g |
| | Ethyl acetate | 120 cc |

The mixture (f) was heated to 55° C. to form a solution. The resulting solution was added to (a) which was warmed to 55° C. in advance, and emulsified using a colloid mill.

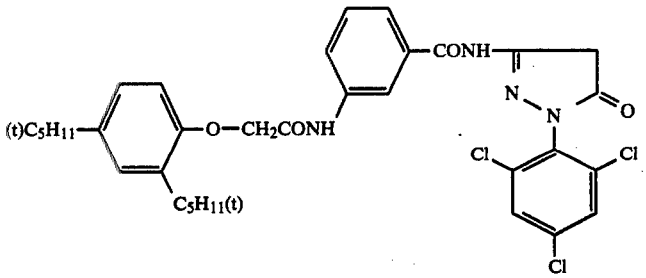

M-101

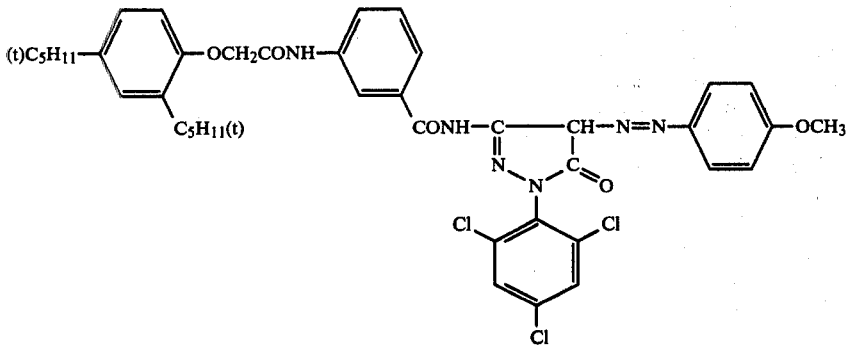

CM-1

Layer-8

A yellow colloidal silver layer (dry coverage: 1.6 microns).

Layer-9

A blue-sensitive silver halide emulsion layer having lower sensitivity was prepared as follows: To a 1 kg portion of the same silver iodobromide emulsion as employed in the layer-3, except that the average grain size was 0.5 micron, were added 20 cc of a 5 wt% aqueous solution of 5-methyl-7-hydroxy-2,3,4-triazaindolizine and 1,500 g of yellow coupler emulsion (5) according to the formula described below. Further, 50 cc of a 2 wt% aqueous solution of 2-hydroxy-4,6-dichlorotriazine sodium salt was added to the above-described emulsion as a gelatin hardener. Thus, a blue-sensitive silver halide emulsion having lower sensitivity was obtained, and coated at a dry coverage of 3.0 microns.

| Emulsion (5) | |
|---|---|
| (a) 10 wt % Aqueous solution of gelatin | 1,000 g |

-continued

| Emulsion (5) | |
|---|---|
| (g) Sodium p-dodecylbenzenesulfonate | 5 g |
| Tricresyl phosphate | 80 cc |
| Yellow coupler (Y-1) | 100 g |
| Ethyl acetate | 120 cc |

The mixture (g) was heated to 55° C. to form a solution. The resulting solution was added to (a), which was warmed to 55° C. in advance, and emulsified using a colloid mill.

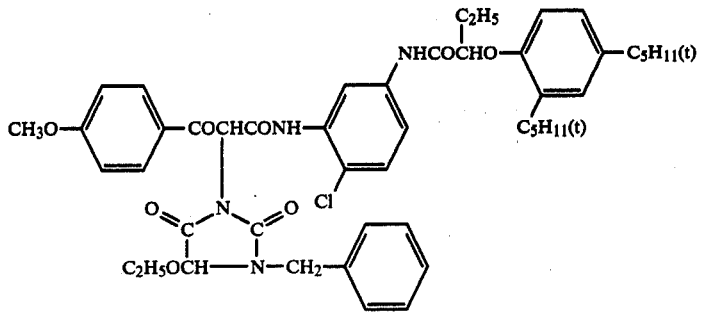

Y-1

Layer-10

A blue-sensitive silver halide emulsion layer having higher sensitivity was prepared in the same manner as in the layer-9, except that the average grain size of the emulsion was altered to 1.1 microns, the addition amount of the emulsion (5) was 300 g, and the dry coverage of the silver halide emulsion was altered to 1.5 microns.

Layer-11

A gelatin protective layer (dry coverage: 1.5 microns).

The thus prepared sample was designated as film A.

Further, the film B and film C were prepared as follows.

Film B

Film B was prepared in the same manner as the film A, except that the emulsion (6), which contained the color mixing inhibitor, was removed therefrom.

Film C

Film C was prepared in the same manner as the film A except that 1,600 cc of a 2% aqueous solution of the compound example (2), which was synthesized according to the steps described in Synthesis Example II, was employed instead of the emulsion (6) containing the color mixing inhibitor.

Each of the above-described films A, B and C was exposed to light under the following conditions, and development-processed according to the processing steps using the processing solutions described below. Then, the degree of the color mixing from the red-sensitive layer to the green-sensitive layer was evaluated.

Exposure: Continuous wedge, Red light, 1/100 sec.

Processing: Development processing (I)

| Development Processing (I) | | |
|---|---|---|
| Processing Step | Temperature | Time |
| Color development | 38° C. | 3 min |
| Washing | " | 1 min |
| Bleaching | " | 2 min or 30 sec |
| Washing | " | 1 min |
| Fixation | " | 2 min |
| Washing | " | 1 min |
| Stabilizing bath | " | 1 min |

| Compositions of Processing Solutions Used in Development Processing (I) | |
|---|---|
| Color Developing Solution | |
| Sodium hydroxide | 2 g |
| Sodium sulfite | 2 g |
| Potassium bromide | 0.4 g |
| Sodium chloride | 1 g |
| Borax | 4 g |
| Hydroxylamine sulfate | 2 g |
| Disodium ethylenediaminetetraacetate | 2 g |
| 4-Amino-3-methyl-N—ethyl-N—(β-hydroxyethyl)aniline monosulfate | 4 g |
| Water to make | 1 l |
| Bleaching Solution | |
| Sodium ferric ethylenediaminetetraacetate (dihydrate) | 100 g |
| Potassium bromide | 50 g |
| Ammonium nitrate | 50 g |
| Boric acid | 5 g |
| Ammonia water to adjust pH to 5.0 | |
| Water to make | 1 l |
| Fixing Solution | |
| Sodium thiosulfate | 150 g |
| Sodium sulfite | 15 g |
| Borax | 12 g |
| Glacial acetic acid | 15 ml |
| Potassium alum | 20 g |
| Water to make | 1 l |
| Stabilizing Bath | |
| Boric acid | 5 g |
| Sodium citrate | 5 g |
| Sodium metaphosphate (tetrahydrate) | 3 g |
| Potassium alum | 15 g |
| Water to make | 1 l |

Results obtained are shown in Table 1 below.

TABLE 1

| Degree of Magenta Coloration through Exposure to Red Light (color mixing) | | | |
|---|---|---|---|
| | Film A | Film B | Film C |
| Degree of Color Mixing ($D_G/D_R$) | 0% | 2% | 0% |

As can be seen from Table 1, in the film B, which did not contain any color mixing inhibitor, 2% color mixing was observed, but on the other hand, the film C, containing the compound example (2) of this invention does not cause the color mixing, analogous to the film A containing the conventionally known color mixing inhibitor.

EXAMPLE 2

A film sample D was prepared in the same manner as in the film A except that the compound example (2) of this invention was added to layer-11 (gelatin protective layer) in such an amount as to have a coverage of 5 g/m$^2$.

Each of film A and film D was subjected to different development processings; the development processing (I), described hereinbefore, and the development processing (II) described below:

Development Processing (II)

Air was bubbled into the color developing solution employed in the developing processing (I) over a period of 3 hours, whereby the color developing solution was deteriorated. The films were developed with the thus exhausted color developing solution.

Then, degree of yellow fog was evaluated and the results obtained are shown in Table 2 below.

TABLE 2

| Yellow Fog due to Use of Fresh and Exhausted Developing Solutions | | | | |
|---|---|---|---|---|
| | Sample | | | |
| | Film A | | Film D | |
| Developing Processing | (I) | (II) | (I) | (II) |
| Yellow Fog | 0.10 | 0.18 | 0.09 | 0.10 |

As can be seen from Table 2, film D, containing the compound of this invention in the gelatin protective layer, can suppress the increase in yellow fog due to the use of the exhausted developing solution.

EXAMPLE 3

Films E, F, G and H were prepared in the same manner as in the film A except that the following alterations were made respectively.

Film E

The support of the film A was altered to a polyethylene terephthalate film.

Film F

The support was altered similarly to the film E and further, the compound example (3) of this invention was added to the layer-2 (gelatin interlayer) in such an amount as to have a coverage of 5 g/m$^2$.

Film G

The support was altered from that of the film A to polyethylene terephthalate exposed to electron beams according to the method as described in U.S. Pat. No. 3,582,333.

Film H

The support was altered to the same support as in film G and furthermore, the compound example (4) of this invention was added to the layer-2 (gelatin inter-layer) in such an amount as to have a coverage of 5 g/m$^2$.

Each of these films E, F, G and H was subjected to the development processing (I).

Then, degree of cyan fog was evaluated and the results obtained are shown in Table 3 below.

TABLE 3

| | Cyan Fog due to Support | | | |
|---|---|---|---|---|
| | Film E | Film F | Film G | Film H |
| Cyan Fog | 0.05 | 0.05 | 0.08 | 0.05 |

As can be seen from Table 3, the increase in cyan fog observed in the case wherein the electron beam exposed polyethylene terephthalate film was employed as a support can be suppressed (in film H) by including the compound of this invention in layer-2.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive element comprising a support and at least one light-sensitive silver halide emulsion layer having a coupler incorporated therein and at least one light-insensitive hydrophilic colloidal layer, said light-insensitive hydrophilic colloidal layer containing from 0.01 to 99 wt% of a polymer comprising at least 0.1 mol% of a repeating unit represented by formula (I)

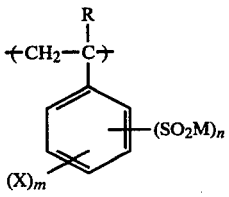

(I)

wherein R represents a hydrogen atom, an alkyl group containing from 1 to 6 carbon atoms, or a halogen atom; M represents a hydrogen atom, an alkali metal atom, an alkaline earth metal atom, or an organic base group; X represents an alkyl group containing from 1 to 6 carbon atoms, an alkoxy group having 1 to 6 carbon atoms, an alkylamino group having 1 to 6 carbon atoms, or a halogen atom; m represents 0, 1 or 2; and n represents 1 or 2.

2. A silver halide color photographic light-sensitive material as in claim 1, wherein said light-insensitive hydrophilic colloidal layer contains from 0.1 to 50 wt% of a polymer comprising at least 1 mol% of a repeating unit represented by formula (I).

3. A silver halide color photographic light-sensitive material as in claim 1, wherein said light-insensitive hydrophilic colloidal layer contains from 1 to 30 wt% of a polymer comprising at least 10 mol% of a repeating unit represented by formula (I).

* * * * *